US005458234A

United States Patent [19]

Harris

[11] Patent Number: 5,458,234

[45] Date of Patent: Oct. 17, 1995

[54] BASKET-STYLE ARTICLE CARRIER

[75] Inventor: Randall L. Harris, Powder Springs, Ga.

[73] Assignee: Riverwood International Corporation, Atlanta, Ga.

[21] Appl. No.: 310,126

[22] Filed: Sep. 21, 1994

[51] Int. Cl.[6] ..... B65D 75/00

[52] U.S. Cl. ..... 206/187; 206/175; 206/427

[58] Field of Search ..... 206/162, 170, 206/174, 175, 180–191, 427

[56] References Cited

U.S. PATENT DOCUMENTS

| | | | |
|---|---|---|---|
| 2,354,528 | 7/1944 | Lowey | 206/183 X |
| 3,191,800 | 6/1965 | Kowal | 206/185 X |
| 3,283,949 | 11/1966 | Wysocle | 206/187 |
| 3,306,485 | 2/1967 | Wood | 206/191 X |
| 3,442,421 | 5/1969 | Donahue | 206/183 |
| 3,465,913 | 9/1969 | Zorn et al. | 206/183 X |
| 3,487,975 | 1/1970 | Riddell | 206/186 |
| 5,031,760 | 7/1991 | Stout | 206/180 |

FOREIGN PATENT DOCUMENTS

| | | | |
|---|---|---|---|
| 2318886 | 10/1973 | Germany | 206/170 |

*Primary Examiner*—Bryon P. Gehman

[57] ABSTRACT

A basket-style carrier which exposes much of the end packaged articles. The carrier has narrow side panels which, with partition straps, form article receiving cells. End cells are formed by the partition straps, side straps extending out from the side panels and end straps connected to the side straps. The partition straps and the end straps are connected to a central support panel, which includes a handle panel portion. The end straps and side straps contact only small portions of the articles, allowing the remainder of the end articles to be viewed.

14 Claims, 3 Drawing Sheets

BASKET-STYLE ARTICLE CARRIER

FIELD OF THE INVENTION

This invention relates to a basket-style carrier for carrying articles such as beverage bottles. More particularly, it relates to a basket-style carrier which allows substantial portions of the packaged articles to be exposed to view.

BACKGROUND OF THE INVENTION

Basket-style carriers are commonly employed to package beverage bottles. They include a separate cell for each bottle, from which the bottles can be readily removed, and a center handle partition for easily carrying the package. The carriers are fabricated from a blank which is folded and glued into collapsed carrier form, after which the collapsed carrier is erected and the bottles inserted.

Basket-style carriers are strong and easy to carry, and their design permits the top portions of bottles packaged in the carrier to be seen. This is advantageous when the distinctive shape of the top portions of the bottles or other packaged articles is suggestive of the brand. The unique shape of some articles, however, is not limited to their top portions but may include their overall appearance, including the design or configuration of the bottom portion. In such cases it is desirable to use a package which exposes as much of the article as possible. This would also expose portions of the label on the bottle, which is normally further unique to the brand of product. It would be expected, however, that such a package might create a problem of carrier strength, since to expose the articles more fully could require structural portions of carriers of conventional design to be eliminated. It would also be expected to create cost problems if the design of the blank from which the carrier is fabricated requires expensive fabrication techniques or if the carrier were to require a two-piece blank.

It is therefore an object of the invention to provide an article carrier which allows major portions of packaged articles to be exposed to view, but which provides adequate strength and is not more expensive than conventional basket-style carriers of comparable size.

BRIEF SUMMARY OF THE INVENTION

The basket-style carrier of the invention includes a bottom panel connected to a central panel and to relatively narrow side panels. End straps extending from the central panel are connected to side straps which extend from the side panels. The end straps and the side straps are spaced from the bottom panel and are relatively narrow compared to the height of the side panels. In addition, partition straps extend from the central panel to the side panels. The side straps and associated end straps and partition straps form end article-receiving cells, while the side panels and associated partition straps form interior article-receiving cells. This enables articles in the end cells of the carrier to be substantially exposed to view.

In a preferred embodiment upper and lower partition straps are provided above and below the end and side straps making up the end cells. Although the central panel is not limited to any one design, preferably it is comprised of a handle panel and connected riser panels, with the partition straps being connected to the riser panels.

The carrier holds articles securely in their cells while exposing substantially the entire shape of the end articles to view. Further, it can readily be formed from a single blank and is easy to load. These and other features and aspects of the invention will be readily ascertained from the detailed description of the preferred embodiments described below.

DETAILED DESCRIPTION OF THE PREFERRED EMBODIMENT

Figure 1:
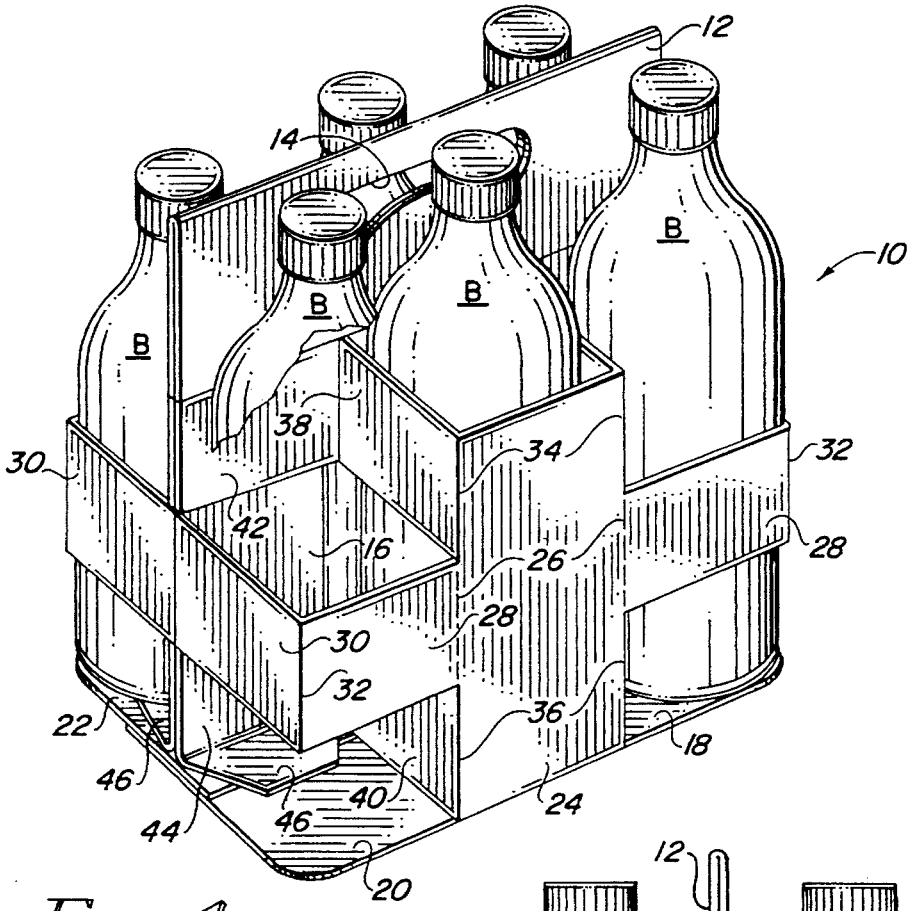
FIG. 1 is a pictorial view of a preferred embodiment of the basket-style carrier of the invention, showing it in connection with six beverage bottles, the near end bottle being broken away in order to reveal the interior of the cell.

Referring to FIG. 1, the basket-style carrier 10 of the invention includes a central handle panel 12 containing a handle opening 14. The central handle panel is connected to end riser panels 16, shown at the left of the carrier, and to end riser panels 17 at the other end of the carrier which are hidden in this view. As described in more detail below, the riser panels are connected to bottom panel 18. The bottom panel 18 is comprised of overlapping flaps 20 and 22 which are foldably connected to the lower edge of narrow oppositely located side panels 24. Extending from fold lines 26 at opposite edges of the side panels 24 are side straps 28 which are connected to end straps 30 by corner fold lines 32. The end straps 30 are also connected to the riser panels 16. Immediately above and below the fold lines 26 of the side panels are fold lines 34 and 36 which respectively connect upper and lower partition straps 38 and 40 to the edges of the side panels 24. The fold lines 26, 34 and 36 are aligned so as to form a substantially continuous fold line. The straps 38 and 40 are connected to the riser panels by upper and lower central support straps 42 and 44, and the lower central support straps 44 are connected to the bottom panel by bottom panel support flaps 46.

Figure 2:
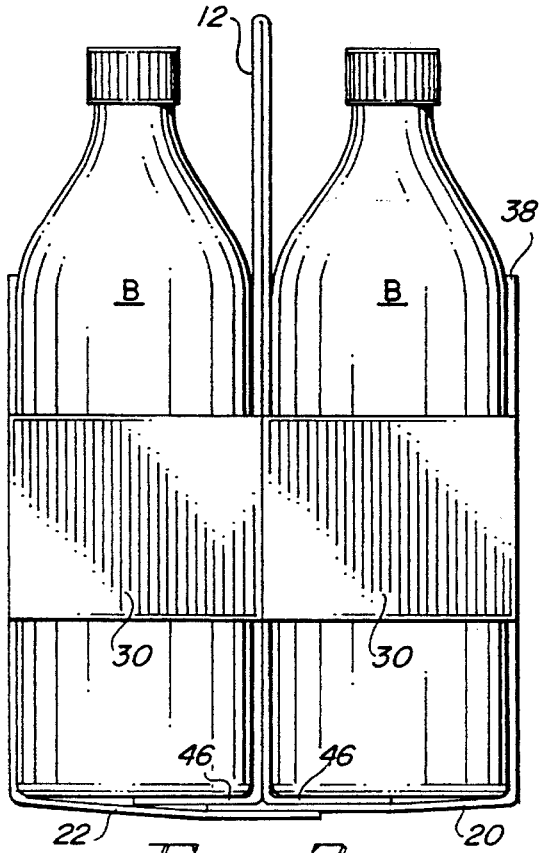
FIG. 2 is an end view of a fully loaded carrier.

The illustrated carrier, which is similarly constructed on both sides of the handle panel, provides six article-receiving cells formed by the side panels and the straps, three on each side of the handle panel. Five of the six cells are shown as containing beverage bottles while the nearest corner cell is shown as being empty in order to better reveal the structure of the carrier. Note that the carrier design permits substantially the entire contour of the end bottles to be on view as well as exposing the upper portion of the center bottles. This is also illustrated in FIG. 2, which shows an end view of a fully loaded carrier. The bottles are snugly held in place within the cells with no risk of falling out. Further, the end straps can be placed so as to cover the pricing code on the bottles. This arrangement thus protects against pricing errors from occurring as a result of automatic price code scanners seeing the pricing code on one of the articles instead of the code on the package itself.

Figure 3:
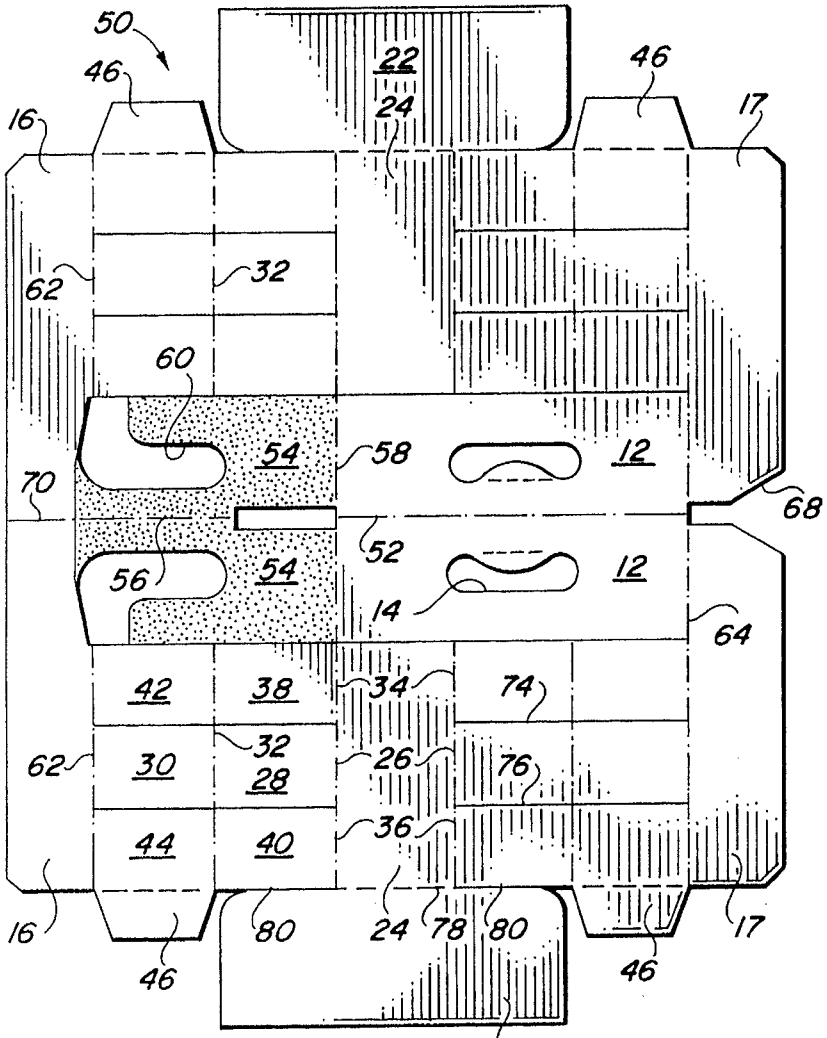
FIG. 3 is a plan view of a blank used to fabricate the carrier.

Referring to FIG. 3, wherein like reference numerals to those used in FIG. 1 denote like elements, a blank 50 for forming the carrier is shown as being of generally rectangular shape. Preferably, the blank is formed from paperboard of the type conventionally used in the carrier industry. Centrally located at the right side of the blank are two similar outer handle panel sections 12 connected together by fold line 52. Immediately to the left of the panel sections 12 are two similar inner handle panel sections 54 which are connected to each other by fold line 56 and to the handle panel sections 12 by fold line 58. The inner handle panel sections 54 contain handle openings 60 which are somewhat larger than the handle openings 14 and are adapted to underlie those handle openings in a carrier formed from the blank. The handle openings 60 are illustrated as extending out to the adjacent corner areas of the inner handle panel sections, which is preferred although not essential, in order to eliminate the narrow strips of material which would otherwise exist between the ends of the openings and the ends of the handle sections and which could present fabrication problems if torn. The fold line 56 is an extension of the fold line 52, and a cutout at the inner end of the fold line 56 is provided to facilitate folding.

Two upper and lower central support strap sections 42 and 44 and end strap sections 30 are connected to the riser panel sections 16 along fold lines 62, while the other two oppositely located upper and lower central support strap sections and end strap sections are connected to the riser panel sections 17 along fold lines 64. The fold lines 62 are separated by a slit 66 which separates the riser panel sections 16 from the inner handle panel sections 54. The fold line 64 is substantially continuous, also connecting the outer handle panel sections 12 to the riser panel sections 17. The fold line may be interrupted, if desired, by a cutout 68 which separates the riser panel sections 17 to facilitate folding. The riser panel sections 16 are not separated by a cutout but are connected by fold line 70, which is a continuation of fold line 56. This arrangement provides better structural continuity to the riser panel sections 16. In addition, the bottom panel support flaps 46 are connected to the lower central support straps 44 by fold lines 72.

Side strap sections 28 are connected by fold lines 32 to end strap sections 30 and to the side panel sections 24 by fold lines 26. Partition strap sections 38 are connected to upper central support strap sections 42 by the fold lines 32 and to the side panel sections 24 by fold lines 34, while partition strap sections 40 are connected to lower central support strap sections 44 by the fold lines 32 and to the side panel sections by fold lines 36. The fold lines 36, 26 and 34 at one side of the blank are continuations of the fold line 58, while these fold lines at the other side of the blank terminate at the outer handle panel sections 12. The end strap sections 30 and the side strap sections 28 are separated from the upper central support strap sections 42 and the partition strap sections 38 by slits 74, and are separated from the lower central support strap sections 44 and the partition flap sections 40 by slits 76. Fold lines 78 connect the side panel sections 24 to a central edge portion of the bottom panel flaps 20, while the remainder of the bottom panel flap edges are separated from the lower partition straps 40 by slits 80. Other than the edges of the handle panel sections connected to the riser panel sections 17, the edges of the handle panel sections are defined by slits, producing free edges when the blank is formed into a carrier.

Figure 4:
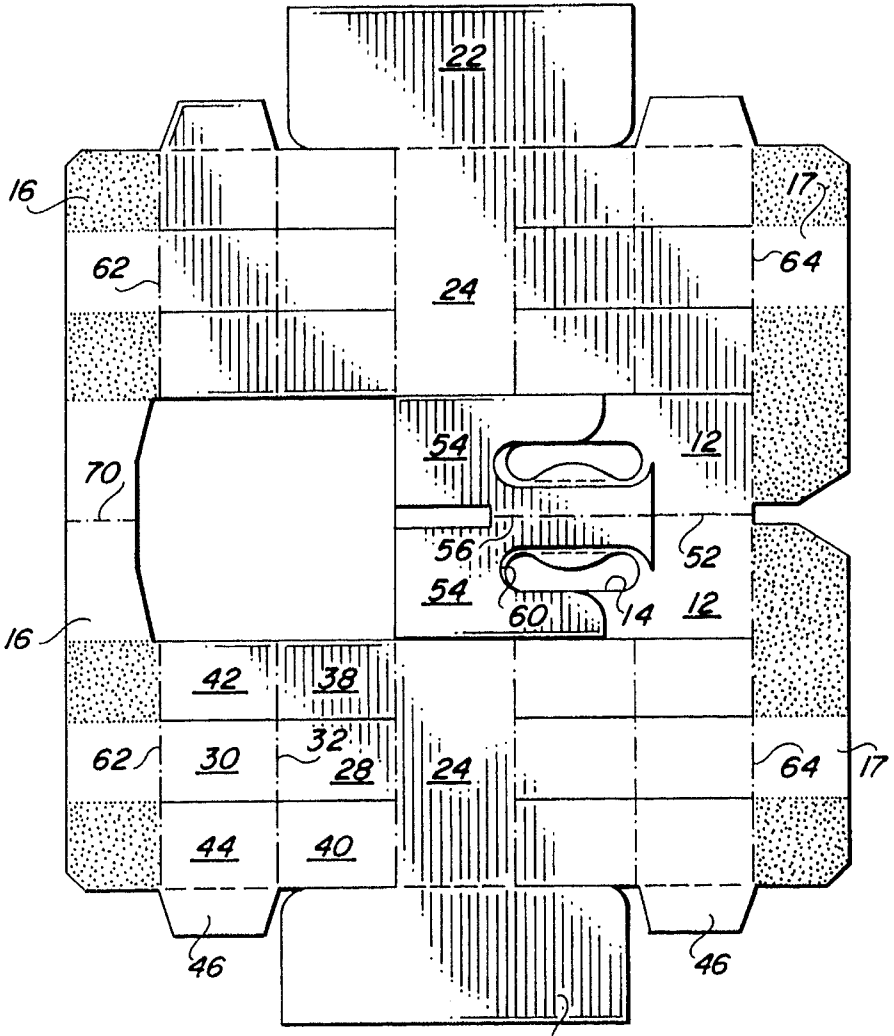
FIG. 4 is a plan view of the carrier blank after an initial folding step.

To form a carrier from the blank the outer handle panel sections 12 are coated with adhesive, as shown in stipple, and the inner handle panel sections 54 are pivoted about fold line 58 onto the outer handle panel sections. The blank with the adhered handle panel sections appears as illustrated in FIG. 4. The next step is to apply adhesive to the areas of the riser panel sections shown in stipple in FIG. 4, then fold them about the fold lines 62 and 64. This adheres the riser panel sections to the upper and lower central support straps 42 and 44 but does not adhere them to the end panel strap sections 30. The riser panel sections 17 are also adhered to the outer handle panel sections 12. These steps result in the interim form of blank shown in FIG. 5.

Figure 5:
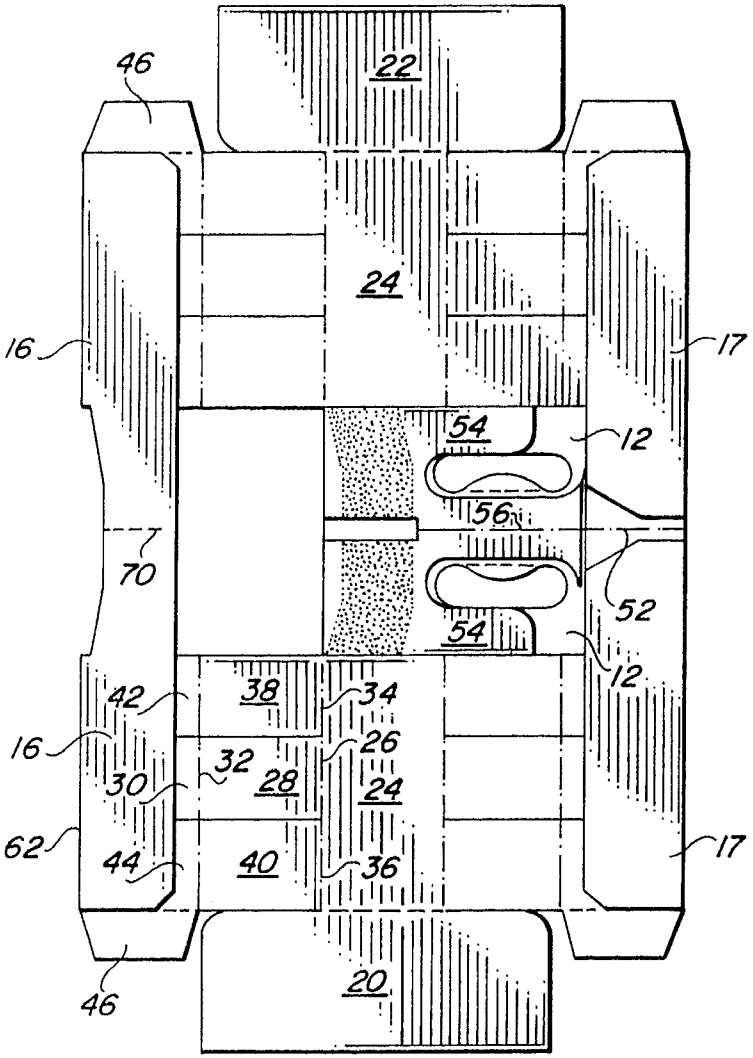
FIG. 5 is a plan view of the carrier blank after a second series of folding steps.

End areas of the inner handle panel sections 54 are then coated with adhesive as shown in stipple in FIG. 5 and the riser panel sections 16 are folded so that the underside of the riser panel sections 16, as viewed in FIG. 5, are brought into contact with the adhesive. This is done by folding the partition strap sections 38 and 40 about the fold lines 34 and 36 so as to be in face-to-face contact with the side panel sections 24 while at the same time maintaining the riser panel sections facing in their original direction. During this procedure the upper and lower central support strap sections 42 and 44 fold about the fold lines 32 to bring these sections into face-to-face contact with the upwardly facing sides of the strap sections 38 and 40. Because the riser panel sections are not adhered to the end panel strap sections 30, the end panel strap sections pivot about the fold lines 32 so as to bring them into face-to-face contact with the side panel strap sections 28 as shown in FIG. 6.

Figure 6:
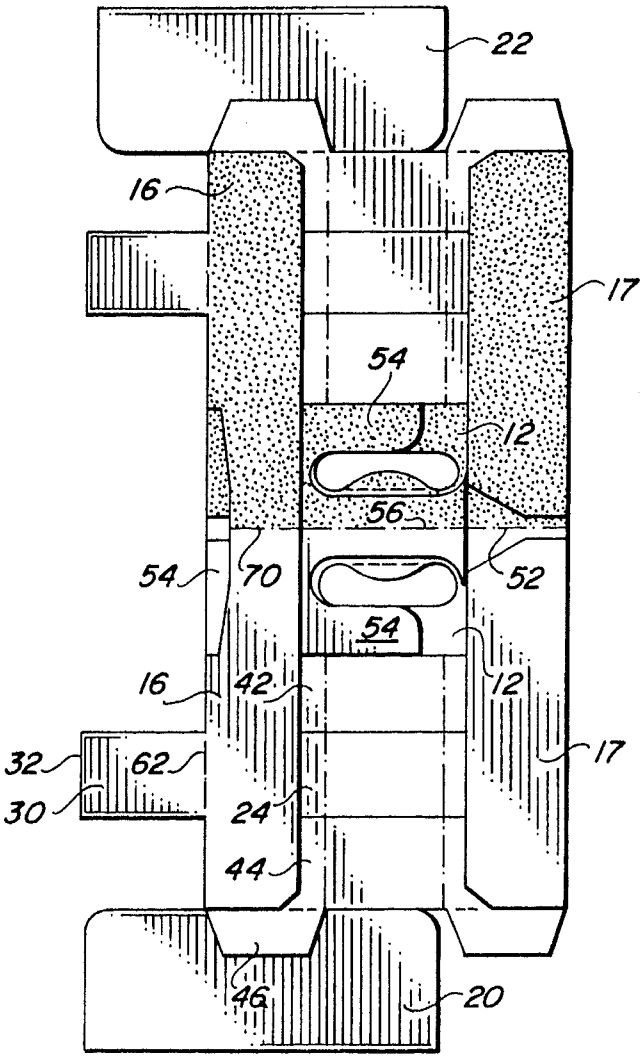
FIG. 6 is a plan view of the carrier blank after additional folding steps.

The final step in forming a collapsed carrier is to coat the riser panel sections and the handle panel sections with adhesive, as shown in stipple in FIG. 6, then fold the blank about the overlying fold lines 52 and 56. This produces the collapsed carrier illustrated in FIG. 7.

Figure 7:
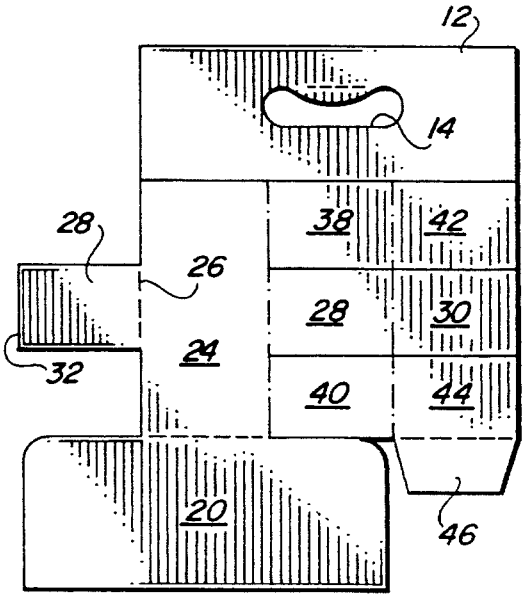
FIG. 7 is a plan view of a collapsed carrier resulting from a final folding step.

To form a carrier from the collapsed carrier of FIG. 7, the collapsed carrier is squared up by folding the side panel sections out to their final positions, which causes the partition strap sections and the side and end strap sections to fold into their final strap positions. The final steps involve folding the bottom panel support flaps 46 out to their final position, then folding the bottom panel flaps 20 into their final overlapped position, gluing the bottom panel flaps to each other and to the support flaps at the same time.

It will be appreciated that the width of the straps may be varied as required, depending on the size and shape of the packaged articles, the amount of the article that is desired to be exposed and the location of the pricing code. In any arrangement, of course, the dimensions would always be enough to provide sufficient strength to hold the articles in place during lifting and shipping of the carrier and not to be at risk of tearing.

While the handle panel and the riser panels are separate elements of the carrier, they may be considered to form together a single central panel to which the partition straps and end straps are connected. It is in this sense that the term "central panel" has been used in the claims.

Although the invention has been described in connection with a carrier designed for holding six bottles, it applies equally as well to carriers designed to hold eight bottles or other types of articles. When used to hold eight articles, the construction of the carrier remains the same but the side panels are widened to provide an interior cell capable of receiving two articles.

It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A basket-style article carrier, comprising:

a substantially vertical central panel having end portions;

a bottom panel connected to the central panel;

opposite side panels connected to the bottom panel, the side panels being relatively narrow compared to the length of the bottom panel;

end straps extending outwardly from the end portions of the central panel;

side straps extending between the end straps and the side panels;

the end straps and the side straps being spaced from the bottom panel and having relatively narrow widths compared to the height of the side panels; and partition straps extending from the central panel to the side panels;

the side straps and associated end straps and partition straps forming with the central panel end article receiving cells, and the side panels and associated partition straps forming interior article receiving cells.

2. A basket-style article carrier as defined in claim 1, wherein the side panels are comprised of upper, lower and intermediate portions, the side straps being connected to the intermediate portions and the partition straps being connected to the upper and lower portions.

3. A basket-style article carrier as defined in claim 1, wherein the partition straps are connected to the central panel by support straps which are foldably connected to the partition straps and adhered to the central panel.

4. A basket-style article carrier as defined in claim 3, wherein at least some of the support straps are adjacent the bottom panel, the bottom panel being connected to the central panel by flaps which are foldably connected to the adjacent support straps and adhered to the bottom panel.

5. A basket-style article carrier as defined in claim 3, wherein the central panel is comprised of a handle panel and spaced riser panels, the support straps being connected to the riser panels.

6. A basket-style article carrier as defined in claim 1, wherein the bottom panel is comprised of overlapping bottom panel flaps which are foldably connected to the side panels.

7. A basket-style article carrier, comprising:

a handle panel connected to spaced substantially vertical riser panels;

a bottom panel connected to the riser panels;

opposite side panels connected to the bottom panel, the side panels being relatively narrow compared to the length of the bottom panel and being comprised of upper, lower and intermediate portions;

end straps extending outwardly from the riser panels;

side straps extending between the end straps and the intermediate portions of the side panels;

the end straps and the side straps being spaced from the bottom panel and having relatively narrow widths compared to the height of the side panels; and upper partition straps extending from the riser panels to the upper portions of the side panels and lower partition straps extending from the riser panels to the lower portions of the side panels;

the side straps and associated end straps and partition straps forming with the riser panels end article receiving cells, and the side panels and associated partition straps forming interior article receiving cells.

8. A basket-style article carrier as defined in claim 7, wherein the upper and lower partition straps are connected to the riser panels by support straps which are foldably connected to the partition straps and adhered to the riser panels.

9. A basket-style article carrier as defined in claim 8, wherein the lower support straps are foldably connected to bottom panel support flaps which are adhered to the bottom panel.

10. A blank for forming a basket-style article carrier, comprising:

adjacent outer and inner handle panel sections, each handle panel section being divided by a central fold line extending through both sections;

riser panel sections on opposite ends of the inner and outer handle panel sections, the riser panel sections extending transversely with respect to the central fold line;

side panel sections adjacent the outer handle panel sections and extending transversely with respect to the central fold line;

side strap sections connected to opposite sides of the side panel sections by fold lines extending at substantially right angles to the central fold line;

end strap sections connected to the side strap sections by fold lines extending substantially parallel to the side strap section fold lines, each end strap section also being foldably connected to an associated riser panel section;

partition strap sections connected to the side panel sections by fold lines extending substantially parallel to the fold lines connecting the side strap sections to the side panel sections;

support strap sections connected to the partition strap sections by fold lines extending substantially parallel to the partition strap section fold lines, each support strap section also being foldably connected to an associated riser panel section; and a respective bottom panel flap connected by a fold line to each of the side panel sections;

the support strap sections being adhered to the riser panel sections in a carrier formed from the blank, and the carrier being comprised of a plurality of article receiving cells, the side panel sections and the partition strap sections forming interior cells and the partition strap sections, the end strap sections and the side strap sections forming end cells.

11. A carrier blank as defined in claim 10, wherein the partition strap sections are connected to the side panel sections on either side of the side strap sections to form upper and lower partition straps in a carrier formed from the blank.

12. A carrier blank as defined in claim 11, including bottom panel support flaps connected to the support strap sections which are connected to the lower partition strap sections.

13. A carrier blank as defined in claim 10, wherein the handle panel sections are separated from the partition strap sections and the support flap sections by slits.

14. A carrier blank as defined in claim 13, wherein the inner handle panel section is unconnected to the associated riser panel section.

* * * * *